US009997894B2

(12) United States Patent
Uegaki et al.

(10) Patent No.: US 9,997,894 B2
(45) Date of Patent: Jun. 12, 2018

(54) SPARK PLUG HAVING A RESISTOR ELEMENT

(71) Applicant: NGK SPARK PLUG CO., LTD., Nagoya-shi, Aichi (JP)

(72) Inventors: Hironori Uegaki, Nagoya (JP); Kazuhiro Kurosawa, Gifu (JP); Katsuya Takaoka, Ichinomiya (JP); Kuniharu Tanaka, Komaki (JP)

(73) Assignee: NGK SPARK PLUG CO., LTD., Nagoya-shi (JP)

( * ) Notice: Subject to any disclaimer, the term of this patent is extended or adjusted under 35 U.S.C. 154(b) by 0 days. days.

(21) Appl. No.: 15/465,649

(22) Filed: Mar. 22, 2017

(65) Prior Publication Data

US 2017/0288374 A1 Oct. 5, 2017

(30) Foreign Application Priority Data

Mar. 31, 2016 (JP) ..... 2016-069897

(51) Int. Cl.
*H01T 13/34* (2006.01)
*H01T 13/40* (2006.01)

(52) U.S. Cl.
CPC ..... *H01T 13/40* (2013.01); *H01T 13/34* (2013.01)

(58) Field of Classification Search
CPC ..... H01T 13/32; H01T 13/04
See application file for complete search history.

(56) References Cited

U.S. PATENT DOCUMENTS

2006/0076865 A1 4/2006 Shibata et al. ..... 313/143
2015/0207299 A1* 7/2015 Ban ..... H01T 13/20 313/141
2015/0263490 A1* 9/2015 Mizuno ..... H01T 13/41 315/58

(Continued)

FOREIGN PATENT DOCUMENTS

EP 2 940 811 A1 11/2015 ..... H01T 13/41
EP 3 089 290 A1 11/2016 ..... H01T 13/20

(Continued)

OTHER PUBLICATIONS

Office Action issued in corresponding Japanese Patent Application No. 2016-069897 dated Feb. 20, 2018 (with English-language machine translation).

*Primary Examiner* — Joseph L Williams
(74) *Attorney, Agent, or Firm* — Kusner & Jaffe

(57) ABSTRACT

A spark plug includes a cylindrical metallic shell having a ground electrode at a forward end of the cylindrical metallic shell, a cylindrical insulator held in the metallic shell, a center electrode disposed in the insulator, a resistor element disposed in the insulator and having a forward end located rearward of a rear end of the center electrode, a forward-end-side electrically conductive seal layer disposed in the insulator to be located between the center electrode and the resistor element, and a rear-end-side electrically conductive seal layer disposed in the insulator to be located rearward of the resistor element. The forward end of the resistor element is located forward of the rear end of the metallic shell, and the rear end of the resistor element is located rearward of the rear end of the metallic shell.

3 Claims, 7 Drawing Sheets

(56) References Cited

U.S. PATENT DOCUMENTS

| | | | | |
|---|---|---|---|---|
| 2015/0325982 | A1* | 11/2015 | Takaoka | H01T 13/04 315/71 |
| 2016/0064904 | A1* | 3/2016 | Niessner | H01T 13/41 315/58 |
| 2016/0218486 | A1* | 7/2016 | Mitsuda | H01T 13/38 |
| 2016/0322789 | A1 | 11/2016 | Takaoka et al. | |
| 2016/0329687 | A1 | 11/2016 | Kasashima et al. | |
| 2017/0179687 | A1* | 6/2017 | Kato | H01T 13/40 |
| 2017/0222405 | A1* | 8/2017 | Nakano | H01T 21/02 313/141 |

FOREIGN PATENT DOCUMENTS

| | | | | |
|---|---|---|---|---|
| JP | 2006-066086 | A | 3/2006 | H01T 13/20 |
| JP | 2007-122879 | A | 5/2007 | C04B 35/457 |
| JP | 2011-222242 | A | 11/2011 | H01T 13/20 |
| WO | WO 2007/147030 | A2 | 12/2007 | H01T 13/20 |
| WO | WO-2015/099081 | A1 | 7/2015 | |

* cited by examiner

SPARK PLUG HAVING A RESISTOR ELEMENT

RELATED APPLICATIONS

This application claims the benefit of Japanese Patent Application No. 2016-069897, filed Mar. 31, 2016.

FIELD OF THE INVENTION

The present invention relates to a spark plug.

BACKGROUND OF THE INVENTION

When a spark plug is energized for ignition of an internal-combustion engine, radio noise is generated from the spark plug. There has been known a method for reducing such radio noise by adjusting the distance between the forward end of a center electrode of the spark plug and the forward end of a resistor element thereof (Japanese Patent Application Laid-Open (kokai) No. 2006-66086).

In recent years, an increasing number of components of an internal-combustion engine have been made of resin for weight reduction. The resin components of the internal combustion engine are low in radio noise suppression performance. Accordingly, the spark plug is required to further suppress such radio noise by itself.

The present invention addresses the above-mentioned problem.

SUMMARY OF THE INVENTION

In accordance with a first aspect of the present invention, there is provided a spark plug comprising a cylindrical metallic shell having a ground electrode at a forward end of the cylindrical metallic shell; a cylindrical insulator held in the metallic shell; a center electrode disposed in the insulator, the center electrode generating spark discharge in a gap between the ground electrode and the center electrode; a resistor element disposed in the insulator and having a forward end located rearward of a rear end of the center electrode; a forward-end-side electrically conductive seal layer disposed in the insulator to be located between the center electrode and the resistor element; and a rear-end-side electrically conductive seal layer disposed in the insulator to be located rearward of the resistor element, wherein the forward end of the resistor element is located forward of a rear end of the metallic shell, and a rear end of the resistor element is located rearward of the rear end of the metallic shell.

According to the present invention, radio noise generated from the spark plug is suppressed. The forward end of the resistor element is located forward of the rear end of the metallic shell, and the rear end of the resistor element is located rearward of the rear end of the metallic shell. The metallic shell and the insulator do not form a capacitor in a range extending rearward of the rear end of the metallic shell. Accordingly, the radio noise flows through the resistor element in a region extending from the rear end of the resistor element to the rear end of the metallic shell. As a result, the radio noise attenuates in the resistor element and the above effect is accomplished.

At least part of a portion of the resistor element located rearward of the rear end of the metallic shell may be a ferromagnetic portion. In this case, high-frequency radio noise is suppressed.

The spark plug may be configured such that the ferromagnetic portion of the resistor element forms a first layer containing metal oxide, a non-ferromagnetic portion of the resistor element other than the ferromagnetic portion forms a second layer containing carbon, and the first layer and the second layer are separated by the electrically conductive glass seal layer. In this case, it is possible to avoid reduction of the metal oxide contained in the ferromagnetic portion, which reduction would otherwise is caused by the carbon contained in the non-ferromagnetic portion. Therefore, it is possible to suppress a deterioration in the property of the first layer which functions as a ferromagnetic body due to the metal oxide contained therein.

DETAILED DESCRIPTION OF THE PRESENT INVENTION

Figure 1:
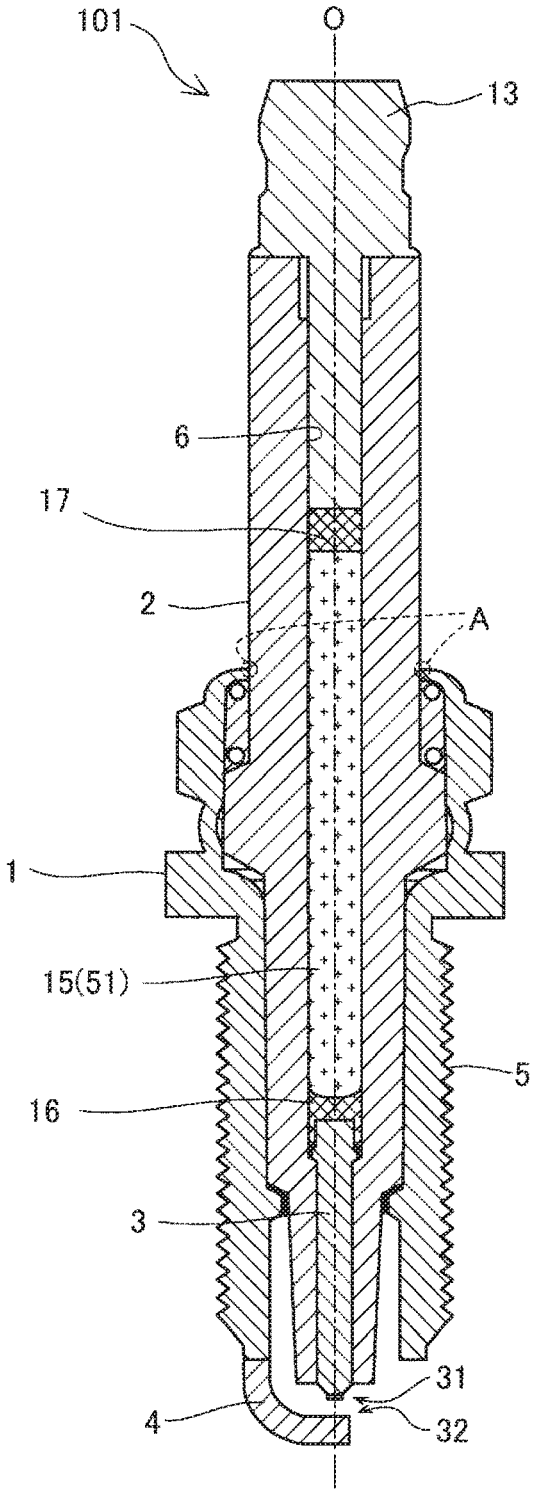
FIG. 1 is a sectional view of a spark plug (first embodiment).

The spark plug 101 includes a metallic shell 1, an insulator 2, a center electrode 3, a ground electrode 4, and a metallic terminal 13. In FIG. 1, the center of the spark plug 101 extending in the longitudinal direction thereof will be referred to as the axial line O. The ground electrode 4 side along the axial line O will be referred to as the forward end side of the spark plug 101. The metallic terminal 13 side will be referred to as the rear end side of the spark plug 101.

The metallic shell 1 is made of metal, such as carbon steel, has a hollow cylinder shape, and constitutes a housing of the spark plug 101. The metallic shell 1 has a ground electrode 4 at its forward end.

The insulator 2 is comprised of a ceramic sintered body, and a forward end portion of the insulator 2 is held in the metallic shell 1. The insulator 2 is a cylindrical member and has an axial hole 6 extending along the axial line O. A portion of the metallic terminal 13 is inserted into and fixed to one end of the axial hole 6. The center electrode 3 is inserted into and fixed to the other end of the axial hole 6.

The center electrode 3 has an ignition portion 31 at its forward end and is disposed in the axial hole 6 with the ignition portion 31 exposed. The center electrode 3 generates spark discharge in a gap between the ignition portion 31 and the ground electrode 4. The ground electrode 4 is welded to the metallic shell 1 at its one end. The ground electrode 4 is bent laterally such that a distal end portion 32 of the ground electrode 4 faces the ignition portion 31 of the center electrode 3 through the gap.

The metallic shell 1 has a thread portion 5 on its outer periphery. The spark plug 101 is mounted onto an engine cylinder head with the thread portion 5.

A ceramic resistor 15 is disposed in the axial hole 6 (that is, inside the insulator 2) to be located between the metallic terminal 13 and the center electrode 3. The ceramic resistor 15 serves as a resistor element 51. Hereinafter, the ceramic resistor 15 will be called the resistor element 51 except the case where attention must be paid to its material. The forward end of the resistor element 51 is located rearward of the rear end of the center electrode 3.

The forward end of the resistor element 51 is electrically connected to the center electrode 3 through a forward-end-side electrically conductive seal layer 16. Namely, the forward-end-side electrically conductive seal layer 16 is disposed in the insulator 2 to be located between the center electrode 3 and the resistor element 51.

The rear end of the resistor element 51 is electrically connected to the metallic terminal 13 through a rear-end-side electrically conductive seal layer 17. Namely, the rear-end-side electrically conductive seal layer 17 is disposed in the insulator 2 to be located at the rear end of the resistor element 51.

The ceramic resistor 15, which functions as electrical resistor between the metallic terminal 13 and the center electrode 3, suppresses the generation of radio noise at the time of spark discharge. The ceramic resistor 15 includes ceramic powder, an electrically conductive material, glass, and a binder (an adhesive). In this embodiment, the ceramic resistor 15 is manufactured through the manufacture steps mentioned below.

The forward end of the resistor element 51 is located forward of the rear end A of the metallic shell 1. In addition, the rear end of the resistor element 51 is located rearward of the rear end A of the metallic shell 1. This configuration suppresses radio noise. The reason is that the metallic shell 1 and the resistor element 51 do not form a capacitor in a region extending rearward of the rear end A of the metallic shell 1.

If the above capacitor is formed, the greater part of high-frequency components contained in the radio noise will flow through the capacitor. This is because the capacitor has a small impedance against the high-frequency components. Accordingly, if the above capacitor is formed, the effect of attenuating the high-frequency components is not expected.

In contrast, if formation of the above capacitor is prevented by the configuration of the present embodiment, the radio noise flows through the resistor element 51 in a region extending from the rear end of the resistor element 51 to the rear end of the metallic shell. As a result, the radio noise attenuates in the resistor element 51, and the above effect is obtained.

The radio noise attenuation effect realized by the R (resistance) component of the resistor element 51 can be enhanced by increasing the R component of the resistor element 51. This effect does not depend on the frequency of the radio noise. Therefore, the low-frequency components and high-frequency components contained in the radio noise can be attenuated.

The present embodiment provides an additional effect. Since the length of the center electrode 3 in the insulator 2 is designed to be short, electrode consumption can be suppressed. The electrode consumption means that the ignition portion 31 is consumed as a result of repetition of spark discharge.

As for the electrode consumption, it is known that the smaller the capacitance of the spark plug 101, in particular, the capacitance of the portion of the insulator 2 located forward of the resistor element 51, the smaller the amount of electrode consumption. The reason is as follows. The insulator 2, located between the center electrode 3 and the metallic shell 1, acts as a capacitor. At the time of spark discharge, the electric charge accumulated in the capacitor flows through the center electrode 3, whereby the electrode is consumed. Therefore, the smaller the amount of the electric charge accumulated in the capacitor, the smaller the amount of electrode consumption, which is advantageous. In order to acquire the above effect, the length of the center electrode 3 in the insulator 2 is designed to be short. In order to achieve this, a portion of the resistor element 51 located rearward of the rear end A of the metallic shell 1 is designed to be longer.

Since the resistor element 51 is a conductor, a capacitor is formed between the resistor element 51 and the metallic shell 1. Therefore, if the resistor element 51 is long, the capacitor has a large capacitance. However, the electric charge accumulated in the capacitor passes through the resistor element 51 at the time of spark discharge. Since the electric charge is converted into heat by the R component of the resistor element 51, the length of the resistor element 51 hardly affects the electrode consumption. In addition, since the electric charge accumulated on the rear end side of the resistor element 51 is converted into heat, the electric charge accumulated on the rear end side of the resistor element 51 hardly affects the electrode consumption.

The portion of the resistor element 51 located rearward of the rear end A of the metallic shell 1 has an electrical resistance of 500Ω or more.

Figure 2:
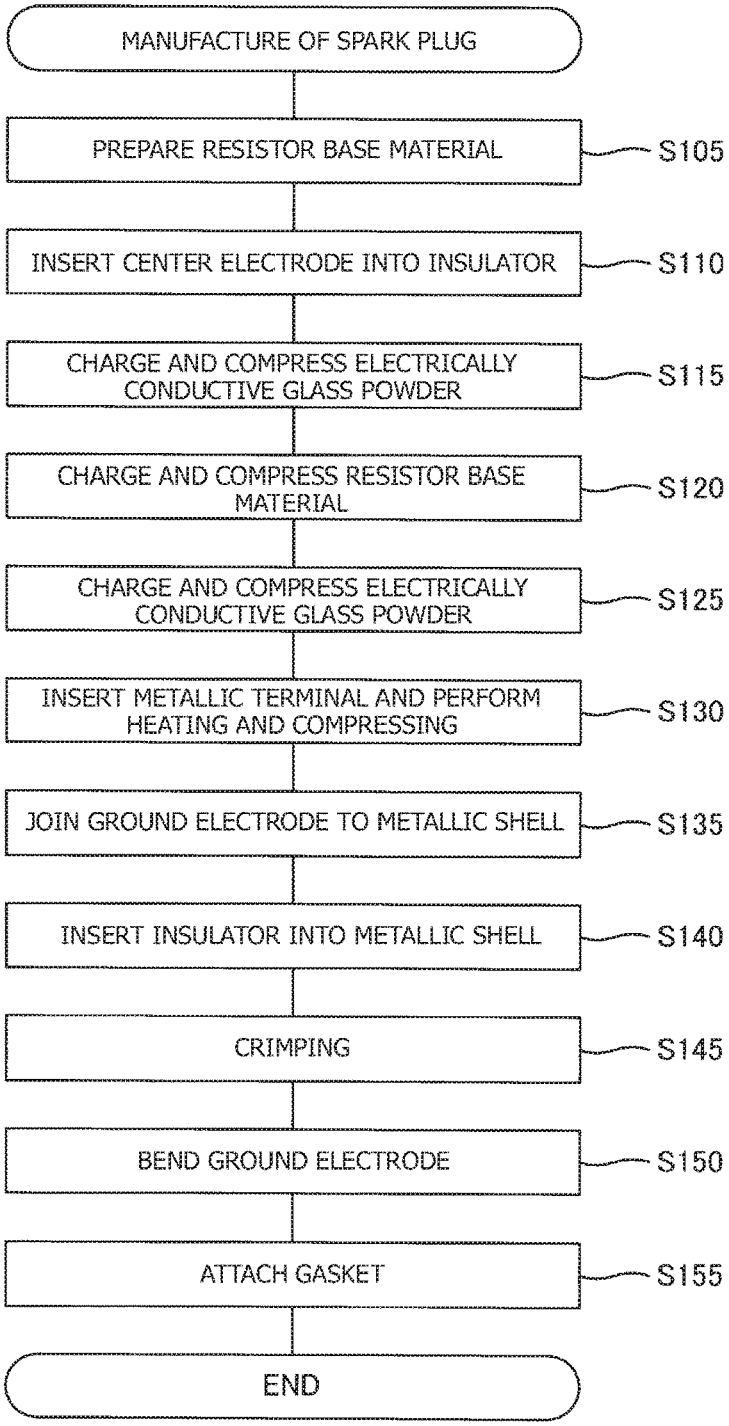
FIG. 2 is a flowchart showing the steps of manufacturing the spark plug.

FIG. 2 is a flowchart showing the steps of manufacturing the spark plug 101. First, the base material of the ceramic resistor 15 is manufactured (S105).

Figure 3:
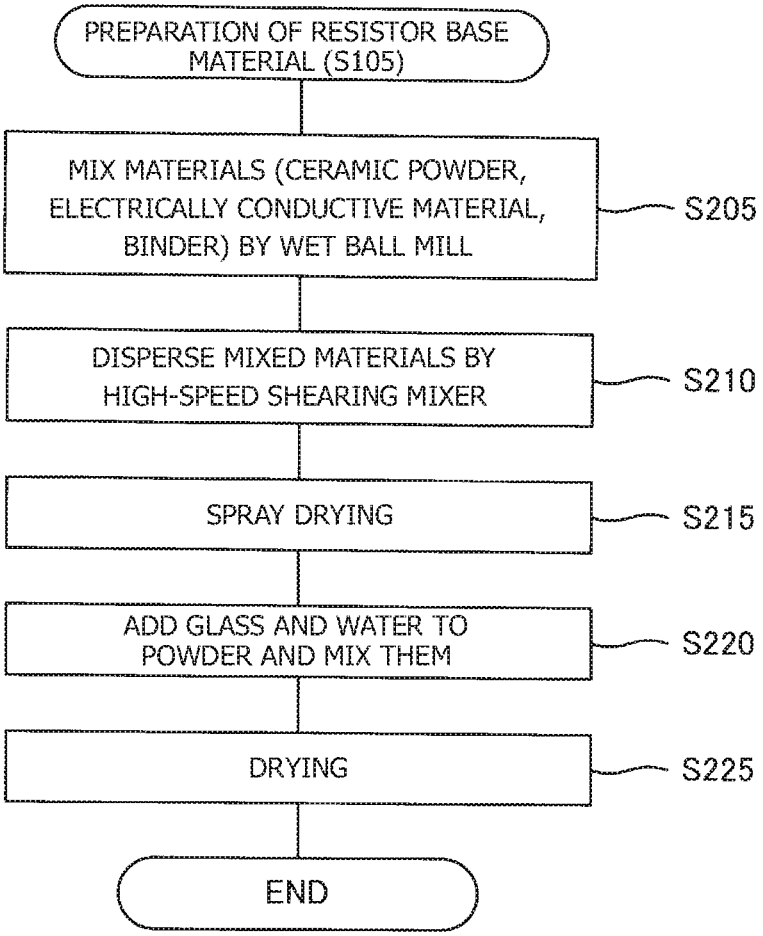
FIG. 3 is a flowchart showing the steps of manufacturing a base material of a ceramic resistor.

FIG. 3 is a flowchart showing the steps of manufacturing the base material of the ceramic resistor 15. First, materials of the base material are mixed by a wet ball mill (S205). These materials include ceramic powder, an electrically conductive material, and a binder. The ceramic powder contains, for example, $ZrO_2$ and $TiO_2$. The electrically conductive material is carbon black, for example. The binder (organic binder) is a dispersing agent such as polycarboxylic acid, for example. Water serving as a solvent is added to those materials, and the resultant solution is agitated and mixed using a wet ball mill. Although these materials are mixed, a degree of dispersion of each material is comparatively low.

Next, the mixed materials are dispersed by a high-speed shearing mixer (S210). A high-speed shearing mixer is a mixer which mixes materials while dispersing the materials to a great degree by using a strong shearing force produced by blades (agitating blades). The high-speed shearing mixer is an axial mixer, for example.

The material obtained in S210 is immediately granulated by the spray-drying method (S215). Water and glass (coarse glass powder) are added to the powder obtained in S215, and the resultant solution is mixed (S220) and dried (S225), whereby the base material (powder) of the ceramic resistor 15 is prepared. The mixer used for the previously-mentioned mixing operation in S220 may be a universal mixer, for example.

Next, the center electrode 3 is inserted into the axial hole 6 of the insulator 2 (S110). Then, an electrically conductive glass powder is charged into the axial hole 6 and is compressed (S115). This compression is achieved by, for example, inserting a rod-shaped jig into the axial hole 6 and pushing the charged conductive glass powder with the jig. The layer of the charged electrically conductive glass powder formed in S115 turns into the forward-end-side electrically conductive seal layer 16 through a heating and compressing step which will be described below. The electrically conductive glass powder is a mixture of copper powder and calcium borosilicate glass powder, for example.

Next, the base material (powder) of the ceramic resistor 15 is charged into the axial hole 6 and compressed (S120). Subsequently, an electrically conductive glass powder is charged into the axial hole 6 and compressed (S125). The layer of the powder formed in S120 becomes the ceramic resistor 15 through the heating and compressing step which will be described below. Similarly, the layer of the powder formed in S125 turns into the rear-end-side electrically conductive seal layer 17 through the heating and compressing step which will be described below. The electrically conductive glass powder used in S125 is the same powder as the electrically conductive glass powder used in S115. The compression method used in S120 and S125 is the same method as the compression method used in S115.

Next, a portion of the metallic terminal 13 is inserted into the axial hole 6, and a predetermined pressure is applied to the insulator 2 from the metallic terminal 13 side while the entire insulator 2 is heated (S130). The materials charged into the axial hole 6 are compressed and fired by the heating and compressing step. As a result, the forward-end-side electrically conductive seal layer 16, the rear-end-side electrically conductive seal layer 17, and the ceramic resistor 15 are formed in the axial hole 6.

Next, a ground electrode is joined to the metallic shell 1 (S135), the insulator 2 is inserted into the metallic shell 1 (S140), and the metallic shell 1 is crimped (S145). The insulator 2 is fixed to the metallic shell 1 as a result of the crimping in S145. Next, the distal end portion of the ground electrode joined to the metallic shell 1 is bent (S150), whereby the ground electrode 4 is completed. Then, a gasket (not shown) is attached to the metallic shell 1 (S155), and the spark plug 101 is completed.

Figure 4:
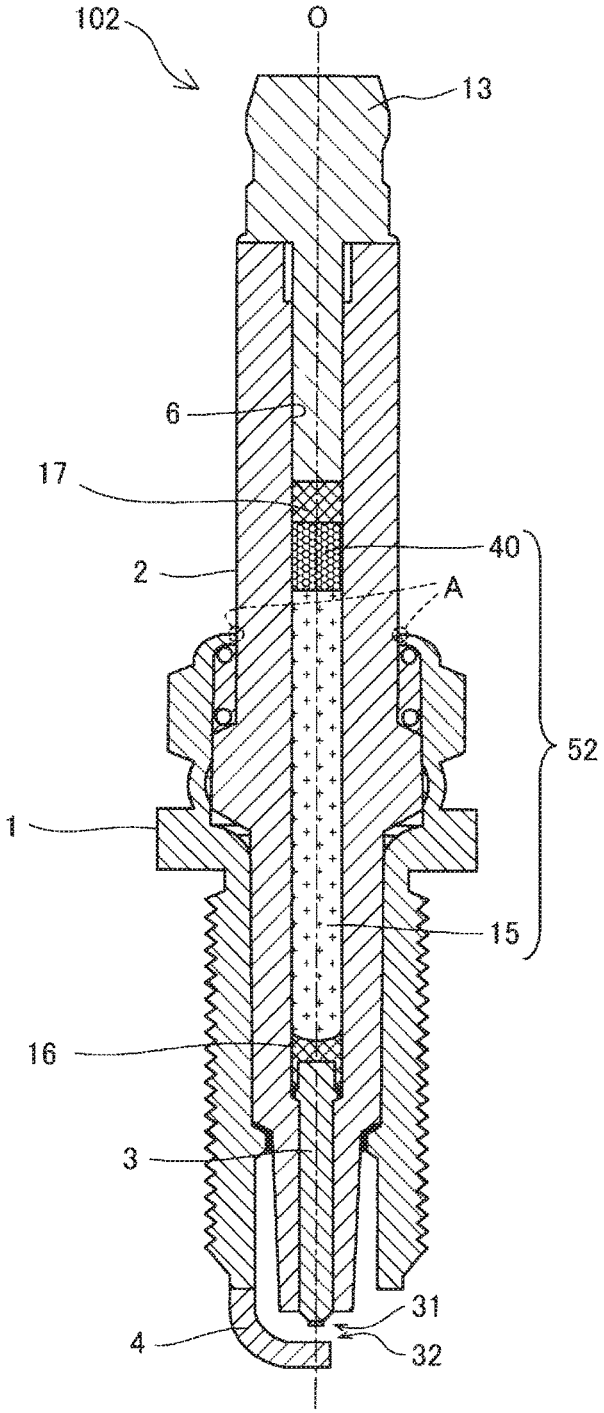
FIG. 4 is a sectional view of a spark plug (second embodiment).

A spark plug 102 according to a second embodiment of the present invention will be described with reference to FIG. 4. The components which are not specifically described in the second embodiment are the same as those of the first embodiment.

The spark plug 102 includes a ferromagnetic layer 40 between the ceramic resistor 15 and the rear-end-side electrically conductive seal layer 17. The ferromagnetic layer 40 includes iron oxide, which is one type of metal oxide. Specifically, the iron oxide is iron (III) oxide, and its chemical formula is $Fe_2O_3$.

In order to provide the ferromagnetic layer 40, a new step is added between S120 and S130 which are mentioned previously. In this step, the base material of the ferromagnetic layer 40 is charged into the axial hole 6 and is compressed.

The ferromagnetic layer 40 and the ceramic resistor 15 constitute a resistor element 52. The ferromagnetic layer 40 is a first layer of the resistor element 52, and the ceramic resistor 15 is a second layer of the resistor element 52. The rear end of the ferromagnetic layer 40 is located rearward of the rear end A of the metallic shell 1. Accordingly, the rear end of the resistor element 52 is located rearward of the rear end A of the metallic shell 1. The rear end of the ceramic resistor 15 is also located rearward of the rear end A of the metallic shell 1.

The ferromagnetic layer 40, which includes iron oxide, exhibits ferromagnetism at the operating temperature of the spark plug 102. The substance having ferromagnetism is more effective in particular for suppression of the radio noise of high-frequency than a substance which does not have ferromagnetism (for example, the ceramic resistor 15). Therefore, since at least a portion of the ferromagnetic layer 40 is located rearward of the rear end A of the metallic shell 1, the radio noise of high-frequency is suppressed. In the spark plug 102, the whole ferromagnetic layer 40 is provided rearward of the rear end A of the metallic shell 1. The substance which does not have ferromagnetism may refer to a substance which exhibits paramagnetism at the operating temperature of the spark plug 102.

Figure 5:
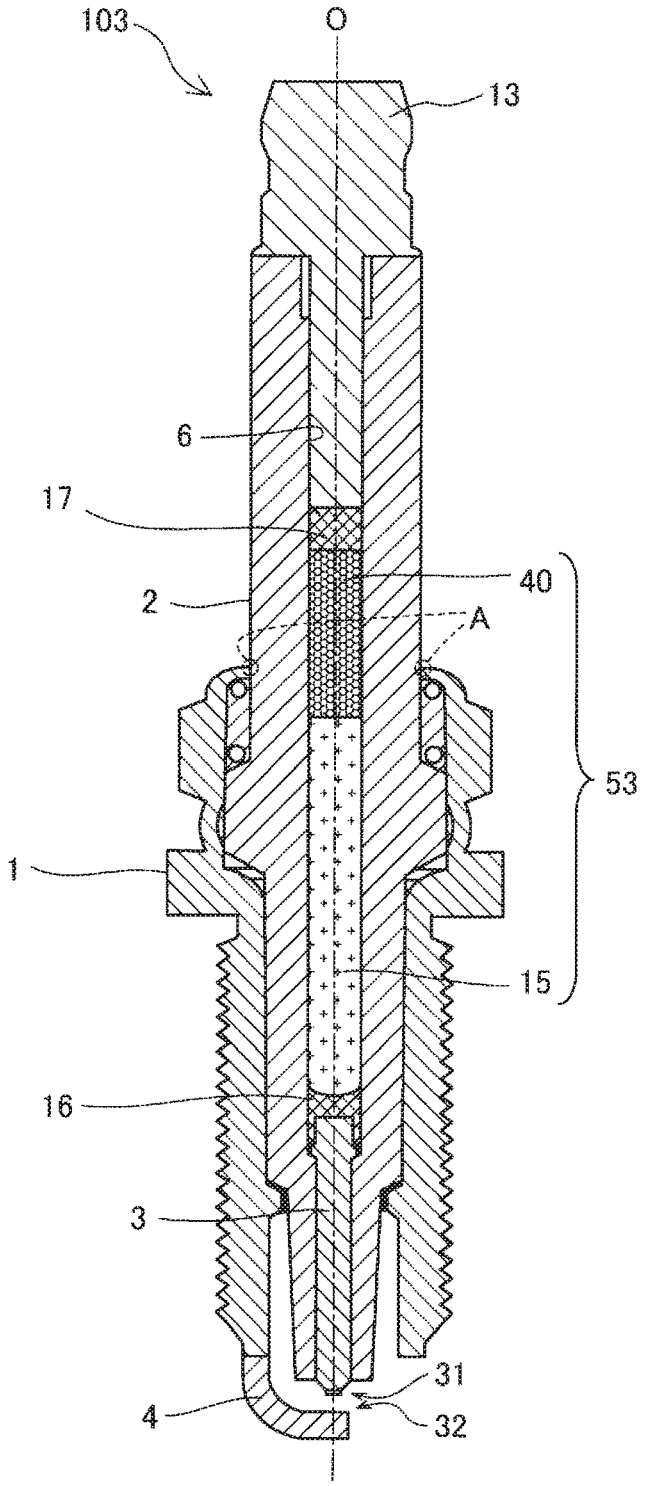
FIG. 5 is a sectional view of a spark plug (third embodiment).

A spark plug 103 according to a third embodiment of the present invention will be described with reference to FIG. 5. The components which are not specifically described in the third embodiment are the same as those of the second embodiment.

The ferromagnetic layer 40 and the ceramic resistor 15 in the spark plug 103 constitute a resistor element 53. A portion of the ferromagnetic layer 40 is disposed forward of the rear end of A of the metallic shell 1. The remaining portion of the ferromagnetic layer 40 is disposed rearward of the rear end of A of the metallic shell 1. Accordingly, the rear end of the ceramic resistor 15 in the spark plug 103 is located forward of the rear end A of the metallic shell 1.

Since the rear end of the ferromagnetic layer 40 is located rearward of the rear end A of the metallic shell 1, the rear end of the resistor element 53 is located rearward of the rear end A of the metallic shell 1. According to the third embodiment, since a portion of the ferromagnetic layer 40 located rearward of the rear end A of the metallic shell 1 is longer than the ferromagnetic layer 40 in the second embodiment, the high-frequency component attenuation effect is higher than that in the second embodiment.

Figure 6:
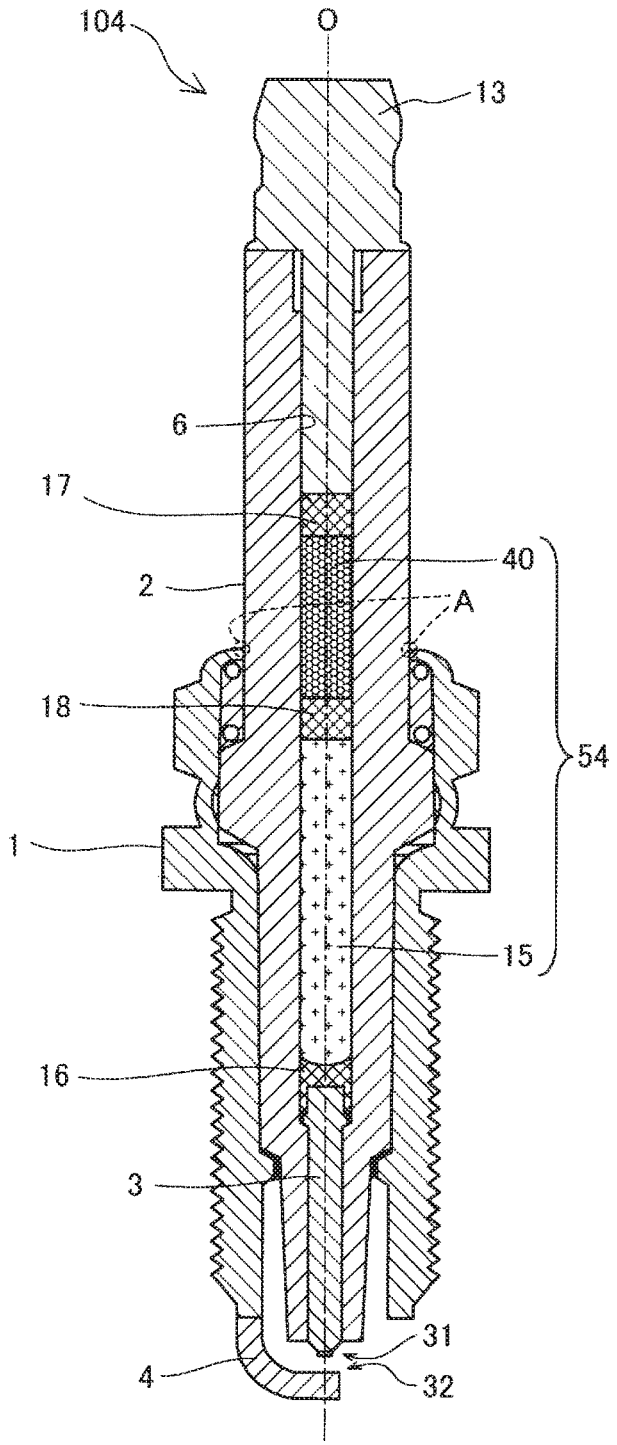
FIG. 6 is a sectional view of a spark plug (fourth embodiment).

A spark plug 104 according to a fourth embodiment of the present invention will be described with reference to FIG. 6. The components which are not specifically described in the fourth embodiment are the same as those of the third embodiment.

The ferromagnetic layer 40 and the ceramic resistor 15 in the spark plug 104 constitute a resistor element 54. An electrically conductive glass seal layer 18 is provided between the ceramic resistor 15 and the ferromagnetic layer 40. The material of the electrically conductive glass seal layer 18 is the same as that of the forward-end-side electrically conductive seal layer 16 and the rear-end-side electrically conductive seal layer 17.

In order to provide the electrically conductive glass seal layer 18, a new step is added between S120 and the step of forming and compressing the ferromagnetic layer 40 (refer to the second embodiment). In this step, electrically conductive glass powder is charged into the axial hole 6 and is compressed.

In the spark plug 104, like the spark plug 103, a portion of the ferromagnetic layer 40 is provided forward of the rear end A of the metallic shell 1. Accordingly, the rear end of the electrically conductive glass seal layer 18 is located forward of the rear end A of the metallic shell 1.

If the iron oxide contained in the ferromagnetic layer 40 is in contact with carbon, the reduction reaction may be promoted. Since the ceramic resistor 15 contains carbon black, the iron oxide may be reduced if it is in contact with the ceramic resistor 15. If the iron oxide is reduced, it will turn to a substance which does not have ferromagnetism. Accordingly, the above-mentioned effect of suppressing the high-frequency radio noise deteriorates.

In this embodiment, since the electrically conductive glass seal layer 18 is provided, the ferromagnetic layer 40 is separated from the ceramic resistor 15. Accordingly, the above reduction hardly occurs, and the effect of suppressing the high-frequency radio noise is maintained.

Figure 7:
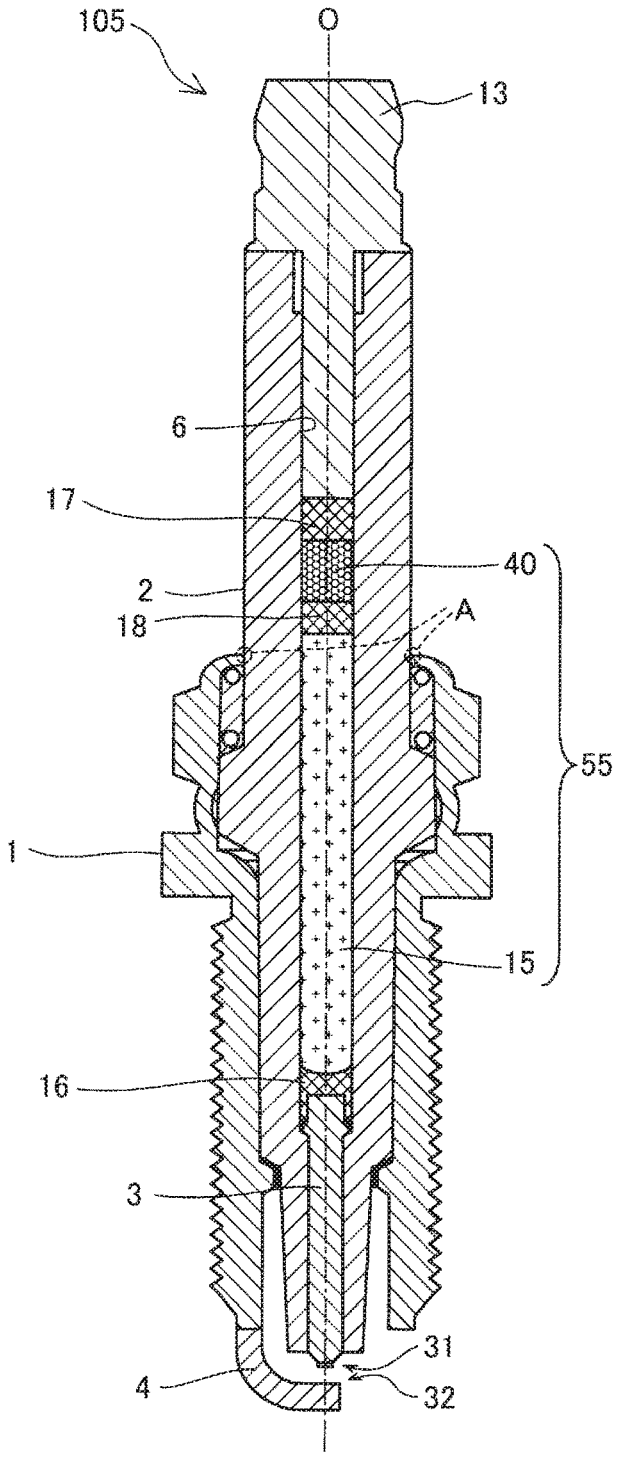
FIG. 7 is a sectional view of a spark plug (fifth embodiment).

A spark plug 105 according to a fifth embodiment of the present invention will be described with reference to FIG. 7. The components which are not specifically described in the fifth embodiment are the same as those of the fourth embodiment.

The ferromagnetic layer 40 and the ceramic resistor 15 in the spark plug 104 constitute a resistor element 55. In a spark plug 105, the rear end of the ceramic resistor 15 is located rearward of the rear end A of the metallic shell 1. Like the fourth embodiment, the rear end of the rear-end-side electrically conductive seal layer 17 is located rearward of the rear end A of the metallic shell 1. Therefore, the rear end of the resistor element 55 is located rearward of the rear end A of the metallic shell 1.

According to the present embodiment, formation of a capacitor by the electrically conductive glass seal layer 18 and the metallic shell 1 can be avoided.

The present invention is not limited to the above-described embodiments and may be embodied in various other forms without departing from the scope of the invention. For example, the technical features in the embodiments corresponding to the technical features in the modes described in "Summary of the Invention" can be appropriately replaced or combined in order to solve some of or all the foregoing problems or to achieve some of or all the foregoing effects. A technical feature which is not described as an essential feature in the present specification may be appropriately deleted. For example, the following modification is possible.

The ferromagnetic layer may contain a metal oxide (for example, chromic oxide) other than iron oxide so as to exhibit ferromagnetism.

DESCRIPTION OF SYMBOLS

1 . . . metallic shell
2 . . . insulator
3 . . . center electrode
4 . . . ground electrode
5 . . . thread portion
6 . . . axial hole
13 . . . metallic terminal
15 . . . ceramic resistor
16 . . . forward-end-side electrically conductive seal layer
17 . . . rear-end-side electrically conductive seal layer
18 . . . electrically conductive glass seal layer
31 . . . ignition portion
32 . . . distal end portion
40 . . . ferromagnetic layer
51 . . . resistor element
52 . . . resistor element
53 . . . resistor element
54 . . . resistor element
55 . . . resistor element
101 . . . spark plug
102 . . . spark plug
103 . . . spark plug
104 . . . spark plug
105 . . . spark plug
A . . . rear end
O . . . axial line Having described the invention, the following is claimed:

1. A spark plug comprising:

a cylindrical metallic shell having a ground electrode at a forward end of the cylindrical metallic shell;

a cylindrical insulator held in the metallic shell;

a center electrode disposed in the insulator, the center electrode generating spark discharge in a gap between the ground electrode and the center electrode;

a resistor element disposed in the insulator and having a forward end located rearward of a rear end of the center electrode;

a forward-end-side electrically conductive seal layer disposed in the insulator to be located between the center electrode and the resistor element; and a rear-end-side electrically conductive seal layer disposed in the insulator to be located rearward of the resistor element, wherein the forward end of the resistor element is located forward of a rear end of the metallic shell, and a rear end of the resistor element is located rearward of the rear end of the metallic shell.

2. A spark plug according to claim 1, wherein the resistor element has a portion located rearward of the rear end of the metallic shell, at least part of the portion being a ferromagnetic portion.

3. A spark plug according to claim 2, wherein the ferromagnetic portion of the resistor element forms a first layer containing metal oxide, a non-ferromagnetic portion of the resistor element other than the ferromagnetic portion forms a second layer containing carbon, and the first layer and the second layer are separated by an electrically conductive glass seal layer.

* * * * *